US005474004A

United States Patent [19]

Badillo

[11] Patent Number: 5,474,004

[45] Date of Patent: Dec. 12, 1995

[54] ROTARY LOOP TAKER WITH A DETACHABLE LOOP SEIZING POINT

[75] Inventor: Paul Badillo, Littleton, Colo.

[73] Assignee: Bakron Corporation, Buffalo Grove, Ill.

[21] Appl. No.: 156,662

[22] Filed: Nov. 22, 1993

Related U.S. Application Data

[63] Continuation of Ser. No. 962,247, Oct. 16, 1992, abandoned.

[51] Int. Cl.[6] ..... D05B 57/14

[52] U.S. Cl. ..... 112/230

[58] Field of Search ..... 112/185, 196, 112/228, 230, 231

[56] References Cited

U.S. PATENT DOCUMENTS

| | | | |
|---|---|---|---|
| 1,928,590 | 9/1933 | Greib | 112/228 |
| 2,523,230 | 9/1950 | Petskeyes | 112/228 |
| 2,839,019 | 6/1958 | Heimann et al. | 112/228 |
| 2,857,869 | 10/1958 | Odermann | 112/228 |
| 3,139,050 | 6/1964 | Grabowski | 112/228 X |
| 3,596,620 | 3/1969 | Vogel | 112/228 |
| 4,966,088 | 10/1990 | Badillo | 112/230 X |

*Primary Examiner*—C. D. Crowder
*Assistant Examiner*—Ismael Izaguirre
*Attorney, Agent, or Firm*—Wood, Phillips, VanSanten, Clark & Mortimer

[57] ABSTRACT

A rotary loop taker for a lock-stitch sewing machine having a detachable loop seizing point and detachable raceway-defining portion. The inwardly facing vertical wall in the middle and final portions of the bobbin case raceway is defined by a replaceable member that in all cases is formed separately from the annular frame. The lower ledge in the middle and final portions of the raceway is defined by a member that may be formed separately from the annular frame, or may be formed integrally with the frame. In the preferred embodiments of the rotary loop taker, the two members referred to may both be formed integrally with the detachable loop seizing point, or only the member that defines the vertical wall may be formed integrally with the loop seizing point. If desired, neither of the two members mentioned may be formed integrally with the detachable loop seizing point.

30 Claims, 8 Drawing Sheets

ROTARY LOOP TAKER WITH A DETACHABLE LOOP SEIZING POINT

This application is a continuation of application Ser. No. 07/962,247, filed Oct. 16, 1992 and now abandoned.

FIELD OF INVENTION

This invention relates to a rotary loop taker for use in a lock-stitch sewing machine in which the take-up device is located above the bobbin case, and in particular to such a loop taker that has a replaceable hook or loop seizing point. The invention is an improvement on the rotary loop taker disclosed and claimed in applicant's commonly assigned application Ser. No. 355,228, filed on Mar. 5, 1982 and now abandoned.

BACKGROUND OF INVENTION

A rotary loop taker is a device that must be incorporated into all lock-stitch sewing machines. Perhaps 70 to 80 per cent or more of all industrial sewing machines are of the lock-stitch type, and therefore utilize a rotary loop taker. Lock-stitch sewing machines of the type described are especially useful for sewing canvas, leather, or other heavy materials.

The conventional loop taker is precision machined of fine steel to accurate proportions and balance throughout its extent from its weighted hub to its fragile hook or "loop seizing point." It is a costly item, and a short-lived item under the heavy wear and tear that accompanies the use of a typical industrial sewing machine. Conventional loop takers have a life of only three to six months, depending on the many variables involved.

The most vulnerable part of the fragile loop seizing point of a rotary loop taker is the tip. The tip can, for example, be chipped by the needle of the sewing machine, or burred by the friction that is created by the high speed revolutions of the loop taker as it picks up the thread off the needle. Since a faulty hook or loop seizing point tends to skip stitches, it must be repaired or replaced whenever the fragile loop seizing point accidentally breaks or becomes too dull through normal wear.

With a rotary loop taker of the conventional type, most factories simply discard the entire device when the loop seizing point (which is conventionally an integrally formed part of the loop taker) becomes chipped or otherwise rendered unusable. Others send the rotary loop taker to a facility that reprocesses the tip of the loop seizing point at great time loss. Either expedient is very costly.

Loop takers of the conventional type are customarily provided with a circular raceway around the inner wall to accept a bearing rib located on the exterior of the bobbin case. It has long been recognized that with use this raceway invariably becomes flawed—especially in the initial portion of the raceway, which is the most vulnerable to damage—and in this condition restricts the free passage of the thread around the bobbin case. As a consequence of such damage to the raceway and resulting restriction of free passage of the thread, thread breakages frequently result.

Another troublesome condition that results from the wearing of the bobbin case raceway in the conventional rotary loop taker is known in the industry as "slop." This condition is the excessive "play" between the bobbin case and the inner wall of the loop taker which defines the bobbin case raceway.

"Slop" interferes with the proper release of the top thread (i.e., the needle thread) from around the bobbin case, and increases the incidence of jamming between bobbin case and raceway. It also tends to cause large, undesirable loops of top thread to be formed on the bottom of the material being sewn, because of the premature closing of the escape exit for the top thread. It may also cause the top thread to break, if a bunching of thread occurs because of the degree of "slop" that is present. Finally, if the "slop" is great enough to produce serious jamming of the top thread, the upper ledge of the bobbin case raceway on the loop seizing point may be broken as the operator manipulates the bobbin case in an attempt to free up the jammed thread.

When the raceway of a rotary loop taker of conventional construction becomes damaged in any manner just described, the entire rotary loop taker must be totally replaced.

The rotary loop taker covered by applicant's above mentioned application Ser. No. 355,228 overcomes the disadvantages of the prior art just discussed. The loop taker of the present invention has the basic advantages of the rotary loop taker covered by that application, and provides additional important advantages as well.

SUMMARY OF THE INVENTION

The rotary loop taker of this invention, which is adapted for rotation about a generally cylindrical bobbin case maintained in a fixed position in a lock-stitch sewing machine below the take-up device of the machine, comprises a frame of substantially annular construction, means for rotatably supporting the frame, a detachable loop seizing point mounted on the frame, and means for detachably securing the loop seizing point to the frame.

As the means for supporting the annular frame rotates during operation of the sewing machine, it rotates the frame about the fixed bobbin case in a predetermined plane, which plane may be horizontal, vertical or other, so long as the take-up device is above the bobbin case. When the means for supporting the annular frame is a rotatable shaft, a vertically oriented shaft will rotate the frame in a horizontal plane, and a horizontally oriented shaft will rotate the frame in a vertical plane.

The frame has a cut-away portion along one segment of its circumference, which portion is defined by opposing end walls of the frame facing upon the cut-away portion. The detachable loop seizing point has generally the same curvature as the substantially annular frame, and has a supporting lug that extends downward into the cut-away portion of the frame and at all times and throughout substantially the entire height of the lug abuts the frame end wall that is at the trailing end of the cut-away portion during rotation of the shaft. The abutting relationship between the mass of the downwardly extending lug and the frame end wall just described provides solid and reliable support for the detachable loop seizing point.

The loop seizing point has a single tapered or reduced, smoothly formed forward end or tip that extends forwardly of the downwardly extending lug into the cut-away portion of the frame. A rear portion of the loop seizing point extends rearwardly of the lug along the annular frame. The detachable loop seizing point is integrally formed from one end to its other end.

The side wall of the bobbin case with which the rotary loop taker of this invention is used carries a radially extending rib for engaging the loop taker as it rotates around the bobbin case. As in rotary loop takers of conventional construction, a raceway is provided on the inner wall of the rotary loop taker for accepting the radially extending rib of the bobbin case, the upper part of the middle and final portions of the raceway being defined by a gib that is detachably secured to the frame.

As in the rotary loop taker of applicant's application Ser. No. 355,228, the detachable loop seizing point of this invention has an inner wall that (1) carries a downwardly facing upper ledge defining the upper part of the initial portion of the bobbin case raceway, (2) carries an upwardly facing lower ledge that defines the lower part of the initial portion of the raceway, and (3) defines an inwardly facing vertical wall for the raceway located between the upper and lower ledges.

The improvement that is made by the present invention is to provide means carried by the substantially annular frame to define the vertical wall and lower ledge of the middle portion (and preferably also the final portion) of the bobbin case raceway, with the part of that raceway-defining means that defines the inwardly facing vertical wall being formed separately from the annular frame in all cases.

In the preferred forms of this invention, the part of the raceway-defining means defining the inwardly facing vertical wall of the bobbin case raceway is formed integrally with the detachable loop seizing point. In one of these preferred forms, both the part defining,the vertical wall and the part defining the upwardly facing lower ledge of the raceway are formed integrally with the loop seizing point. In another prefer red form of the invention, the part of the raceway-defining means that defines the upwardly facing lower ledge of the bobbin case raceway is formed integrally with the substantially annular frame or otherwise separate from the loop seizing point, and only the part of the raceway-defining means that defines the inwardly facing vertical wall is formed integrally with the loop seizing point.

In other embodiments, both of the indicated parts—i.e., the parts carried by the annular frame that define the inwardly facing vertical wall and the upwardly facing lower ledge—are formed separately from the loop seizing point. In these cases, the parts in question may be formed integrally with each other or entirely separately from each other. In the latter case, the part of the raceway-defining means that forms the inwardly facing vertical wall of the raceway may be an entirely separate spacer member in the form of a segment of a circle, or it may be formed integrally with the gib.

As mentioned above, in all forms of this invention the part of the raceway-defining means carried by the substantially annular frame that defines the inwardly facing vertical wall is formed separately from the annular frame.

To fabricate a rotary loop taker in these various ways with replaceable elements defining the inwardly facing vertical wall and the upwardly facing lower ledge of the middle and final portions of the bobbin case raceway provides important advantages, as will be discussed below. Replacing the parts that define the vertical wall and the lower ledge as members formed integrally with each other has certain advantages, and replacing those parts separately has certain other advantages, all to be discussed below in this specification.

PRIOR ART

Many prior art patents have attempted without success to provide operable rotary loop takers with detachable loop seizing points that have extended for a minor portion only of the circumference of the annular frame on which the loop seizing point is mounted. These have included, among others, the patents to Joseph U.S. Pat. Nos. 2,495,637 issued Jan. 24, 1950, Corey No. 3,140,681 issued Jul. 14, 1964, Corey No. 3,223,060 issued Dec. 14, 1965, and Kuhar No. 3,465,700 issued Sep. 9, 1969. In all these patents, the detachable loop seizing point has been of vertically laminated construction, or in other words it has been laminated in layers that are parallel to the shaft or axis of rotation of the rotary loop taker.

Loop seizing points of vertically laminated construction unavoidably present cracks in which the needle thread loop can get caught, either in the operation of the sewing machine in a forward direction or (as is more or less common for certain purposes) in the reverse direction. Such laminated devices also present other cracks in which lint and dirt can be trapped. In addition, a vertically laminated loop seizing point is inherently weaker, and usually possesses less total mass and thus provides a less solid construction, than an integrally formed loop seizing point, Finally, some specialized hooks are so thin in the radial direction with respect to the annular supporting frame that vertical lamination is not feasible.

All four patents just referred to not only have the disadvantages of vertical lamination, but in addition have no teaching of the replacement of any portion at all of a worn or damaged bobbin case raceway, much less the entire raceway.

The patent to Corrall et al. U.S. Pat. No. 2,002,172 issued May 21, 1935 discloses a replaceable member that extends around most of the circumference of the rotary loop taker, but the device not only has no upper ledge (since the hook is of the open raceway type), but in addition it fails to replace the damaged or worn lower ledge of any portion at all of the bobbin case raceway. Furthermore, the Corrall et al. device—like the other patents just discussed —is of vertically laminated construction, with all the disadvantages that such construction entails.

The patent to Parry U.S. Pat. No. 2,716,956 issued Sep. 6, 1955 does not relate to replacement of a loop seizing point, but only to the replacement of a small portion of the upper ledge of a bobbin case raceway. Furthermore, it does not disclose replacement of a damaged or worn lower ledge or vertical inner wall of any portion at all of a raceway.

Italian patent No. 524,944 granted to Borletti Apr. 30, 1955 likewise does not disclose the replacement of a loop seizing point. Moreover, it relates only to a redesign of a portion of the bobbin case raceway in original equipment rather than the replacement of any portion of a worn or damaged raceway after it has been used, and the further fact is that if anyone sought to apply the Borletti invention to replacement of a portion of worn or damaged raceway, it would not work.

Dickson patent No. 1,431,380 issued Oct. 10, 1922 attempted to provide a detachable loop seizing point that was integrally formed rather than of vertically laminated construction, but for the reasons pointed out in applicant's application Ser. No. 355,228, that device was wholly inoperable. The novel device disclosed and claimed in application Ser. No. 355,228 unexpectedly overcame the fatal deficiencies of the Dickson device.

Now the present invention departs from the expedient employed in the device of that co-pending application of replacing only the initial portion of the bobbin case raceway, and thus makes it possible to replace the lower ledge and vertical wall of the entire raceway whenever that is necessary.

ADVANTAGES OF THIS INVENTION

Replacement of the middle and final portions of the bobbin case raceway in accordance with the present invention introduces one or more extra steps for the operator of the machine when a worn or damaged detachable loop seizing point is replaced, and in this respect this invention goes directly against one of the basic objectives both of Dickson's unsuccessful effort almost 60 years ago and applicant's successful device covered by his application Ser. No. 355,228. However, this change of direction unexpectedly makes available a number of very important advantages in addition to the basic advantages provided by the invention of Ser. No. 355,228.

As will be seen from the following discussion, these advantages relate to the ease of manufacturing a rotary loop taker (simpler, faster, more accurate, and less expensive), to greater flexibility in the selection of materials to be used in manufacturing such devices, and to substantial savings and convenience in replacing worn or damaged parts when such devices are in place in an industrial sewing machine.

1. With the preferred forms of this invention, it is now possible to achieve greater accuracy in the replaced raceway taken as a whole, and it is no longer necessary to hold manufacturing tolerances within the narrow limits that are required with a two-piece replaceable raceway.
2. When a damaged loop seizing point is repaired by the conventional technique of sanding or buffing the hook down, this unavoidably changes the dimensions of the hook and makes it necessary to shut the sewing machine down in order to re-time the hook. This type of machine downtime is avoided entirely with either the replaceable loop seizing point of this invention or of application Ser. No. 355,228, because the dimensions of the new hook and of the old hook before it became damaged or worn are the same, and therefore no re-timing is necessary when the new hook is installed in the machine.

The present invention significantly reduces machine downtime of still another type. Downtime of this type cannot be avoided altogether, even with a detachable loop seizing point, but with the instant invention it can be reduced by a very substantial amount. This type of downtime is associated with replacement of the shaft or base on which the rotary loop taker is supported, which among other reasons is made necessary in a conventional rotary loop taker—or even in the invention of application Ser. No. 355,228—whenever the underlying annular frame of the loop seizing point must be replaced.

If a rotary loop taker has no detachable loop seizing point, it follows that when any part of the loop taker is sufficiently worn or damaged, the device must be replaced in its entirety. This will of course include replacement not only of the annular frame but also of the shaft or base on which the frame is mounted.

If a rotary loop taker has a detachable loop seizing point but only the initial portion of the bobbin case raceway is replaced when a new loop seizing point is installed, as in the device of Ser. No. 355,228, this will at one and the same time repair the damage to the point itself and compensate for a substantial amount of the wear in the inwardly facing vertical wall of the bobbin case raceway. Nevertheless, after a period of time the accumulation of further damage to the middle and final portions of the raceway (especially to the vertical wall) will require that the annular frame defining those portions of the raceway also be replaced. This in turn will again require replacing the shaft or base on which the frame is supported.

In both these cases, replacing the shaft or base will necessitate re-timing the hook carried by the frame.

As will be evident, the time at which the annular frame and the shaft or base on which it is supported must be replaced is determined in a conventional rotary loop taker, and even in the invention of application Ser. No. 355,228, by the life of the middle and final portions of the raceway, rather than by the life of the annular frame itself. In contrast to this situation, in the present invention the entire raceway—or at least the inwardly facing vertical wall of the entire raceway—may be replaced when the condition of the middle and final portions thereof requires such replacement. This means that it is the life of the annular frame itself, rather than the life of the middle and final portions of the raceway, that determines when the frame and thus the shaft or base in which it is supported must be replaced (with resulting downtime caused by the re-timing that is required after any such replacement) because of damage to the frame.

Since the vertical wall of the bobbin case raceway typically suffers more damage in use than the lower ledge of the raceway, the advantage just described is present in the embodiments of this invention in which only the vertical wall is replaced, as well as in those embodiments in which both the vertical wall and the lower ledge are replaced.

Under medium to heavy conditions of use, the life of the middle and final portions of the raceway of a typical rotary loop taker is estimated to be about three months. Under similar conditions, the life of the underlying annular frame is estimated to be about 6–9 months if the bobbin case opener eccentric is attached to the annular frame of the loop taker, and of indefinite duration if the eccentric is carried separately by the loop taker shaft. Thus the life of the underlying annular frame that carries the detachable raceway and detachable loop seizing point of the present invention is typically at least two or three times longer than the life of the raceway itself. It follows that with the present invention the annular frame will have to be replaced no more than one-third to one-half as often as will be the case when only the initial portion of the raceway is replaced, and in some cases even less frequently than that.

It is estimated that each time the hook and any special attachments (such as an undertrimmer) of an industrial sewing machine have to be re-timed, the machine will be out of commission for an average of at least two hours. By greatly reducing the number of times the sewing machine is shut down for the re-timing of the hook that is required when not only the raceway but also the annular frame by which it is carried are replaced, the present invention results in a very substantial saving in both the idle operator's time and the mechanic's time and, of course, an increase in the production obtained from a given machine.

3. In addition to the important reduction in machine downtime just described, a further cost saving results from use of this invention because the same annular frame is left in place in the saddle through several replacements of the raceway, thus using up fewer frames.
4. The separate fabrication of the bobbin case raceway in the present invention makes it possible to construct the underlying annular frame of the rotary loop taker of a different material from the steel of which the raceway and loop seizing point are ordinarily formed. The annular frame can be constructed, for example, of a synthetic, high speed, low load, long wearing, polymeric material such as the acetal copolymer sold by Celanese Corporation under the trademark "Celcon," which is less expensive (in terms of both materials and fabrication cost) per unit part than steel, requires no oiling of the frame, shaft or eccentric as is necessary with steel frames, and should provide a longer useful life than steel frames do. Thus, further savings both in manufacturing costs and in downtime costs will result from the use of the indicated material for the underlying annular frame of the loop taker.

5. Separate fabrication of the bobbin case raceway also makes it possible to construct various parts of the raceway itself of a suitable synthetic polymeric materials such as just mentioned for the annular frame. This will again have the advantages that the polymeric materials is less expensive and easier to fabricate than steel, requires no oiling of the raceway, and will have a longer useful life than steel.

The fact that no oiling of the raceway is needed is especially important because it will avoid the discoloration of the needle thread, bobbin thread, and/or fabric that is often caused by the application of oil to the radially extending rib of the raceway or to the bobbin case raceway itself. It will also minimize the presence of lint that is frequently trapped, and soaked, by accumulated oil residues in and around the raceway.

If the inwardly facing vertical wall of the bobbin case raceway is formed of steel throughout the length of the raceway, there should be no alignment problem whatsoever. If, at the same time, the lower ledge of the raceway to the rear of the detachable loop seizing point is made of a suitable synthetic polymeric material—whether formed integrally with or separately from the annular frame—several advantages will result. The rotary loop taker will be easier to manufacture, both because the raceway need not be ground out of a steel part and because the plastic part of the raceway can be fabricated by an injection molding technique. The replaceable loop seizing point will require less material and thus be less expensive to manufacture. And, as already point out above, less oiling will be needed, even though some oiling will still be needed because of the steel vertical wall on the raceway.

6. When the detachable loop seizing point and the various parts of the raceway-defining means carried by the annular frame are formed separately from each other, manufacturing tolerances must be stricter, but to balance this the method of fabricating the separate parts can be less complicated and difficult and, as already suggested, there can be greater flexibility in the selection of the materials from which the various parts are made.

7. If desired, the gib (ordinarily made of steel) may define both the upper ledge and the vertical wall of the bobbin case raceway below that ledge. The resulting problem in achieving the proper alignment of parts at the junction between the gib and the portion of the bobbin case raceway defined by the detachable loop seizing point may be outweighed by the ability to relieve the jamming of thread ("thread lock") when that condition occurs during use of the industrial sewing machine in which the rotary loop taker of this invention is installed. As indicated above, with a typical rotary loop taker this condition often leads to the breaking of the upper ledge of the loop seizing point if the operator removes the conventional gib (which defines only the upper ledge of the raceway) and manipulates the bobbin case in an attempt to relieve the jamming of the thread.

Although it requires more steps to replace the parts involved in the present invention than are required in the practice of the invention covered by application Ser. No. 355,228, it is seen that this invention adds several important advantages to the other advantages already provided by that earlier invention.

The invention is defined in the attached claims in terms of the rotary loop taker as a whole, and also in terms of the detachable loop seizing point itself in combination with raceway-defining means for the middle portion (and preferably the final portion as well) of the bobbin case raceway.

BRIEF DESCRIPTION OF THE DRAWINGS

This invention will now be described with reference to the attached drawings in which.

DETAILED DESCRIPTION OF SEVERAL EMBODIMENTS

Several embodiments of the rotary loop taker of this invention are described below.

According to this invention, means to define the middle portion, and preferably also the final portion, of the bobbin case raceway is carried by the substantially annular frame of the rotary loop taker. This raceway-defining means has two parts. The first of these is the part that defines the inwardly facing vertical wall of the indicated portions of the bobbin case raceway, and the second is the part that defines the upwardly facing lower ledge of the raceway. The part that defines the vertical wall is in every case formed separately from the substantially annular frame of the rotary loop taker.

In the preferred forms of this invention, at least the part that defines the vertical wall of the middle and final portions of the raceway is integrally formed with the detachable loop seizing point, as a rearward extension of the latter that follows the generally circular configuration of the annular frame. The detachable loop seizing point may also be (as in the first embodiment described below) integrally formed with the part of the raceway-defining means that defines the upwardly facing lower ledge of the indicated portions of the raceway. Or, if desired, the loop seizing point may be (as in the second and third embodiments described below) integrally formed with only that part of the raceway-defining means that defines the vertical wall of the raceway, with the part that defines the upwardly facing lower ledge being formed separately from the loop seizing point.

In other forms of this invention, both the part of the raceway-defining means that defines the vertical wall of the raceway, as well as the part that defines the upwardly facing lower ledge, of the middle and final portions of the raceway are formed separately from the detachable loop seizing point.

Both Vertical Wall And Lower Ledge Of Raceway-Defining Means Formed Integrally With Detachable Loop Seizing Point

A.

Figure 1:
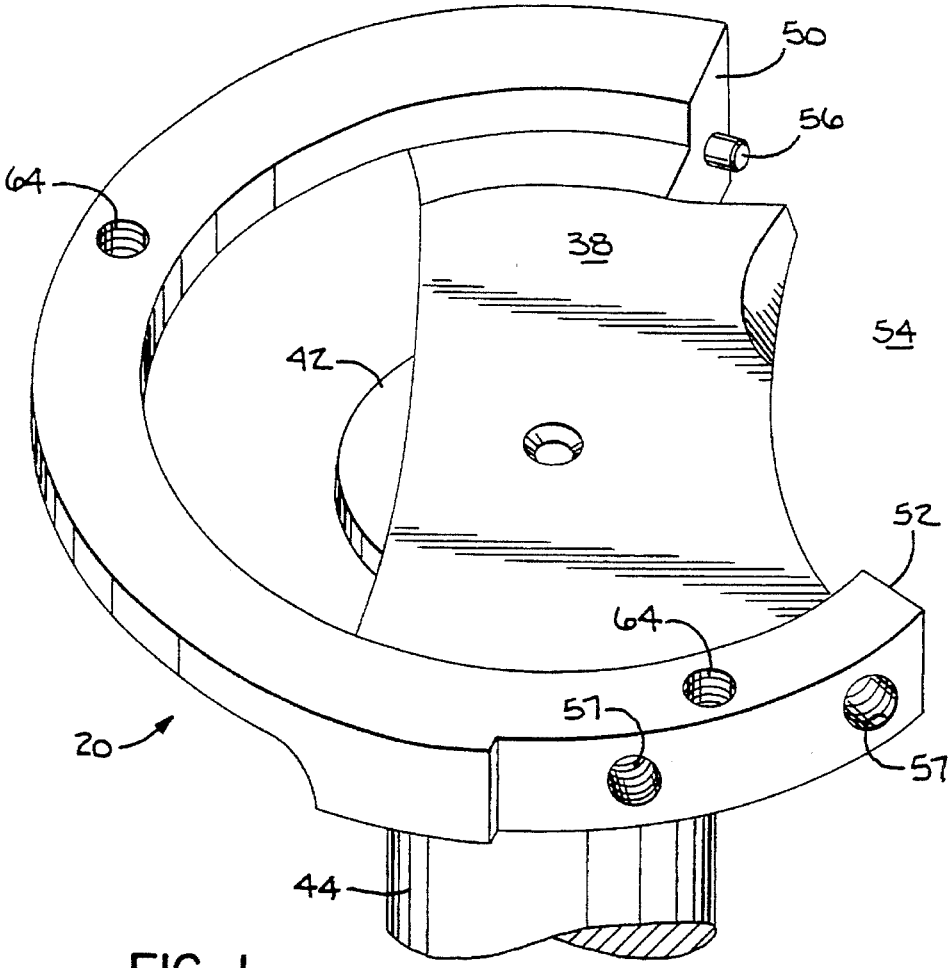
FIG. 1 is a three-quarters perspective view from the top of the substantially annular frame that is included in a first embodiment of the rotary loop taker of this invention.

FIG. 1 shows a substantially annular frame 20 that is included in a first preferred embodiment of the rotary loop taker of this invention.

Figure 2:
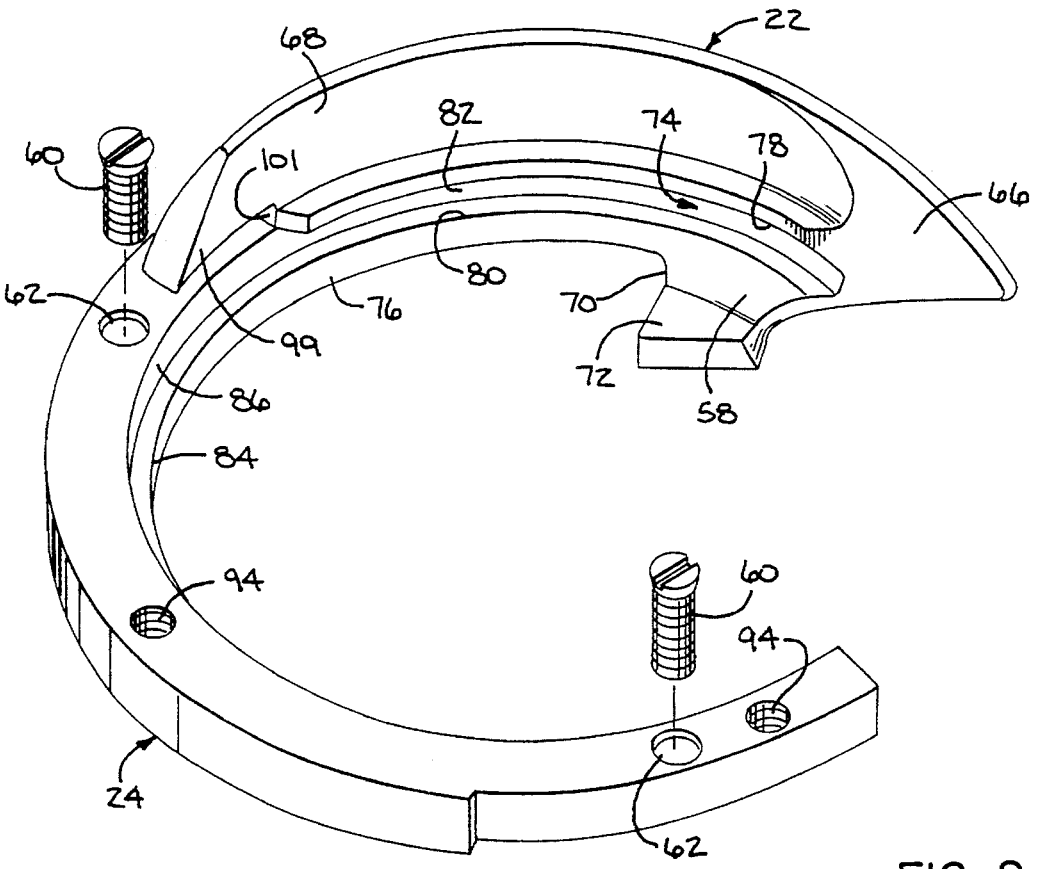
FIG. 2 is a similar view of the combination loop seizing point and bobbin case raceway-defining means that is included in said first embodiment of the rotary loop taker of this invention.
Figure 3:
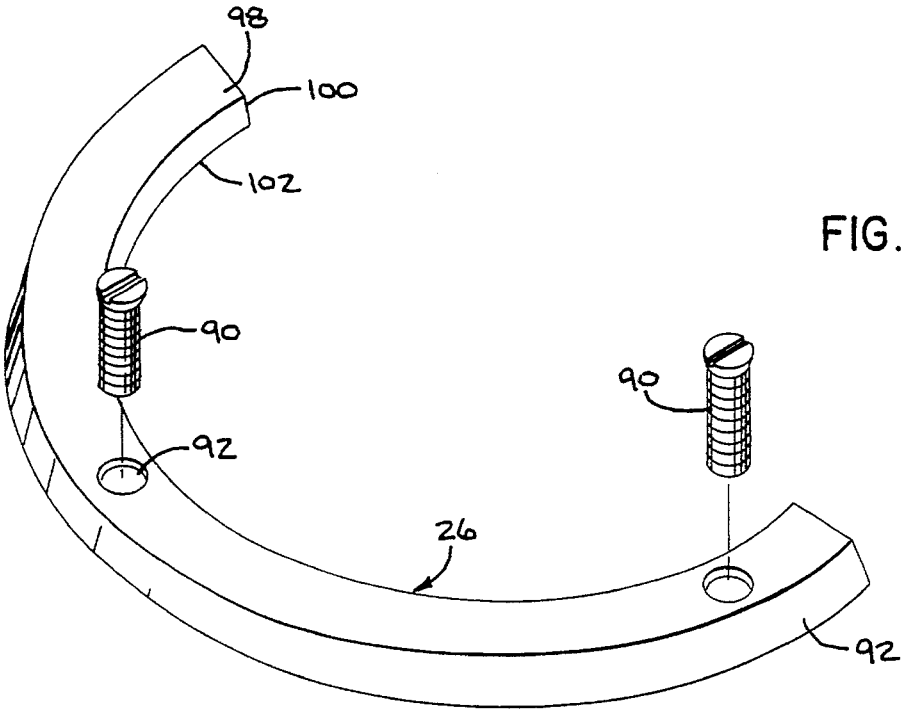
FIG. 3 is a similar view of the gib that is included in said first embodiment of the rotary loop taker of this invention.

To summarize briefly the assembly of this embodiment, the combination shown in FIG. 2 of detachable loop seizing point 22 and bobbin case raceway-defining means 24 is first secured to frame 20. After the radially extending rib of the bobbin case (not shown) is inserted in the resulting partially formed raceway, gib 26 shown in FIG. 3 is secured to combination member 22/24, and thus indirectly to frame 20, to complete the raceway. Finally, needle guard 28 shown in FIG. 4 (on the same page as FIG. 1) is attached to frame 20.

A more detailed description of this embodiment, in which both the vertical wall and the lower ledge of raceway defining means are formed integrally with detachable loop seizing point 22, follows.

General Construction of Rotary Loop Taker

Substantially annular frame 20 is shown in FIG. 1 in the horizontal position it occupies when in place in a lock-stitch sewing machine of conventional construction in which the take-up device (not shown) is located above the bobbin case (also omitted for clarity) of the machine.

In the embodiment illustrated, annular frame 20 is supported by crosswise support member 38 extending from one side of the frame to the other. Crosswise support member 38 is in turn attached to a rotatable shaft (not shown), at generally right angles thereto, through disk 42 and hub 44. When the rotary loop taker is in use in a lock-stitch sewing machine, the rotatable shaft is oriented in a vertical position.

The rotatable shaft is attached, through hub 44 and disk 42, to the bottom surface of cross-wise extending support member 38. This arrangement of parts provides means for rotatably supporting frame 20 in the lock-stitch sewing machine. The shaft is in turn connected to the actuating mechanism of the sewing machine, and during use of the machine is rotated to cause frame 20 to revolve in a horizontal plane about the associated bobbin case.

A portion of substantially annular frame 20 is cut away along one segment of its circumference. As seen in FIG. 1, opposing end walls 50 and 52 of the frame face upon, and define, cut-away portion 54 of frame 20.

In a lock-stitch sewing machine, the needle penetrates the material being sewn and when it starts to withdraw from that material it forms on the underside of the material a loop of needle thread, which is hooked by the loop seizing point of the rotary loop taker as the latter begins a revolution. The loop of needle thread is then passed around the bobbin case as the loop taker rotates, to be pulled off by the take-up device near the end of a full revolution of the loop taker. Cut-away portion 54 of frame 20 provides space for the needle thread to exit from the loop seizing point and to be pulled away from the bobbin case as the rotary loop taker completes its revolution and the needle thread is pulled off the loop seizing point by the take-up device.

Needle guard 28 extends from frame 20, to which it is attached by bolts 56, into frame cut-away portion 54. Bolts 56 are inserted in threaded holes 57 in frame 20.

Loop Seizing Point With Downwardly Extending Lug

Detachable loop seizing point 22 is mounted on annular frame 20 by seating positioning post 56 which is carried by end wall 50 of the frame (FIG. 1) in a mating cavity (not shown) in the rear wall of downwardly extending lug 58 on member 22, and inserting bolts 60 in place through chamfered apertures 62 in raceway-defining means 24 and into threaded holes 64 in annular frame 20 (FIGS. 1 and 2). As will be seen, post 56 and attaching means 60/62/64 are located entirely rearward of tapered forward end 66.

Loop seizing point 22 has generally the same curvature as substantially annular frame 20. Tapered or reduced forward end 66 extends into cut-away portion 54 of frame 20, and rear portion 68 extends in the other direction along annular frame 20.

Lug 58 extends directly downward from detachable loop seizing point 22, intermediate between the front and rear ends of the loop seizing point, from just behind tapered forward end 66. The lug extends into cut-away portion 54 of frame 20 and abuts end wall 50 of the frame, which is at the trailing end of cut-away portion 54 during rotation of the rotatable shaft in the clockwise direction, as seen in FIG. 1, during operation of the sewing machine. Specifically, rear surface 70 of downwardly extending supporting lug 58 abuts at all times, throughout substantially the entire height of the lug, the surface of end wall 50.

Form and Dimensions Of Loop Seizing Point

Detachable loop seizing point 22 is integrally formed from tapered or reduced forward end 66 to the rear end of rear portion 68. Tapered forward end 66, which extends forwardly of downwardly extending lug 58, is a single, smoothly shaped, integrally formed element. Loop seizing point 22 preferably has no other projection extending forwardly of lug 58. Rear portion 68 extends rearwardly of lug 58 along annular frame 20.

The thickness of forward end 66 of loop seizing point 22 measured radially of annular frame 20 adjacent downwardly extending supporting lug 58 is substantially equal to the thickness of frame 20 measured in the same radial direction. This will provide strength, rigidity and stability to forward end 66 under the rigorous conditions of use in a typical commercial lock-stitch sewing machine.

Form and Dimensions Of Downwardly Extending Lug

As pointed out in applicant's application Ser. No. 355,228 in connection with a discussion of the abutting relationship in the rotary loop taker of that invention that is similar to the relationship between the mass of downwardly extending lug 58 and frame end wall 50, such a relationship provides a solid and reliable support for a detachable loop seizing point like member 22. For best results, it is important that this mass be quite substantial in order for a sufficiently stable and secure attachment to be effected between loop seizing point 22 and frame 20 that detachable member 22 will be able to withstand the quite severe mechanical stresses to which it is subjected during normal operation of a commercial sewing machine.

Thus, as further explained in applicant's said co-pending application, it is preferred that the thickness of lug 58, exclusive of any inwardly extending lug foot 72 that may be present, measured radially of annular frame 20 be substantially equal to the thickness of the frame measured in the same direction. It is further preferred that the length of lug 58 measured along the circumference of annular frame 20 be at least substantially equal to the radial thickness of frame 20, and that the depth of the downwardly extending lug measured axially of frame 20 also be at least substantially equal to the radial thickness of the frame.

In the embodiment of the rotary loop taker disclosed in FIGS. 1 through 4, the depth of downwardly extending supporting lug 58 is approximately equal to the radial thickness of annular frame 20, which provides a very secure attachment of loop seizing point 22 to annular frame 20, as is necessary in any industrial sewing machine.

Passing Of Loop Around Bobbin Case

During the operation of an industrial sewing machine, the needle (not shown) moves up and down in vertically reciprocating motion as it penetrates and withdraws from the material being sewn. At the same time, rotary loop taker 20 rotates in a clockwise direction about the stationary bobbin case and past the needle. As it moves past the needle, forward end 66 of loop seizing point 22 picks up a loop of needle thread and carries the loop around the bobbin case until it is released near the end of one full revolution of the loop taker.

The objective of the forming and circling of the needle thread loop around the bobbin case just described is to cast a loop of needle thread around the bobbin thread so as to form a lock-stitch as the material is sewn, with the needle thread disposed in the final stitch along one side of the material and the bobbin thread disposed along the other side.

Lower Ledge And Vertical Wall Of Raceway Integrally Formed With Detachable Loop Seizing Point Throughout Raceway The side wall of a typical bobbin case with which the rotary loop taker of this invention is used carries a radially extending rib to guide the loop taker in its rotation around the case. The complementary structure in the rotary loop taker with which the radially extending rib of the bobbin case is engaged is bobbin case raceway 74 (FIG. 2).

The rotary loop taker of the instant invention, like the invention disclosed in application Ser. No. 355,228, provides an initial portion of bobbin case raceway 74 which is defined by ledges carried by detachable loop seizing point 22. The loop seizing point has an inner wall 76 that carries downwardly facing upper ledge 78, upwardly facing lower ledge 80, and inwardly facing vertical wall 82 between the two ledges.

The rotary loop taker illustrated in FIGS. 1 through 4 includes an upwardly facing lower ledge 84 that is integrally formed with detachable loop seizing point 22 and extends rearward from rear portion 68 of the loop seizing point along the circumference of annular frame 20. Inwardly facing vertical wall 86 extends along the circumference of frame 20 with, and is spaced radially outward from, lower ledge 84.

Members 84 and 86, integrally formed with each other and with detachable loop seizing point 22, comprise raceway-defining means 24 carried by frame 20. The raceway-defining means, which defines the middle and final portions of raceway 74, is detachably secured to frame 20 by previously mentioned bolts 60, between frame 20 and semicircular gib 26.

As will be seen, raceway-defining means 24 carried by annular frame 20 defines upwardly facing lower ledge 84 and inwardly facing vertical wall 86 in at least the middle portion of the raceway, and in the preferred embodiment shown it defines that ledge and vertical wall in the final portion of raceway 74 as well.

In this embodiment, as well as in all other embodiments of the present invention, it is important to note that at least the part of the raceway defining means that defines vertical wall 86 is formed separately from annular frame 20.

Semi-circular gib 26 is detachably secured to raceway-defining means 24, and thus to frame 20, by means of bolts 90 which are inserted in chamfered apertures 92 and screwed into threaded apertures 94 in bobbin case raceway-defining means 24. As will be seen, bolts 90 are only long enough to pass through the gib and be threadably inserted in apertures 94 in member 24.

When gib 26 is installed in place, its forward end portion 98 extends under overhang 99 of rear portion 68 of loop seizing point 22. Forward end wall 100 of gib 26 abuts rear end wall 101 of detachable loop seizing point 22. The gib defines downwardly facing upper ledge 102 of raceway 74 in the middle and final portions of the raceway.

Only Vertical Wall Formed Integrally With Detachable Loop Seizing Point

B.

Figure 5:
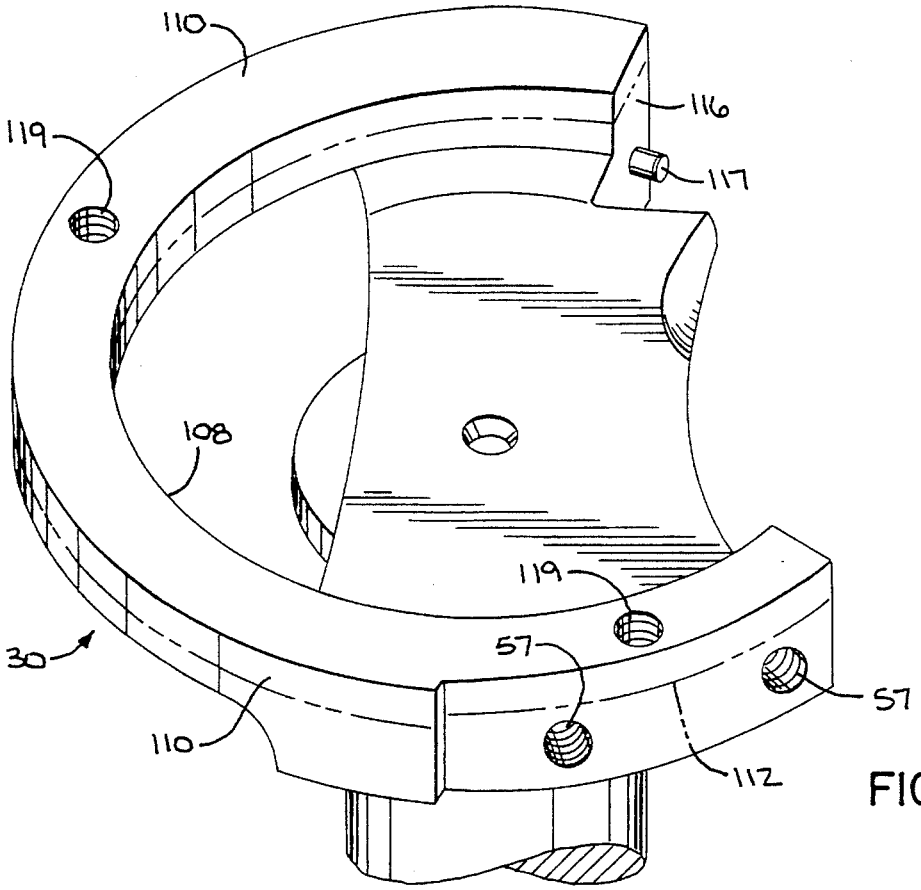
FIG. 5 is a similar view of the substantially annular frame that is included in a second embodiment of the rotary loop taker of this invention.

Substantially annular frame 30 of FIG. 5, detachable loop seizing point 103 and raceway-defining means 104 of FIG.

6, and gib 26 of FIG. 3 are included in a second preferred embodiment of the rotary loop taker of this invention.

Figure 4:
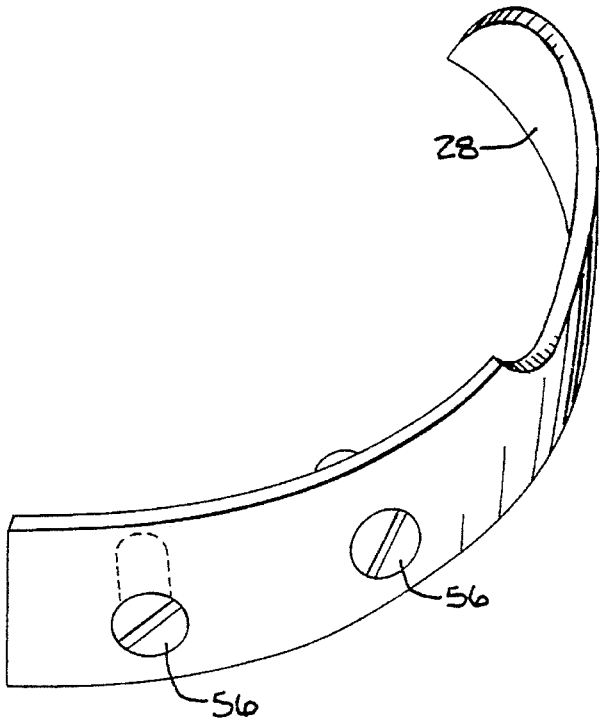
FIG. 4 (on the same sheet as FIG. 1) is a similar view of the needle guard that is included in said first embodiment of the rotary loop taker of this invention.
Figure 6:
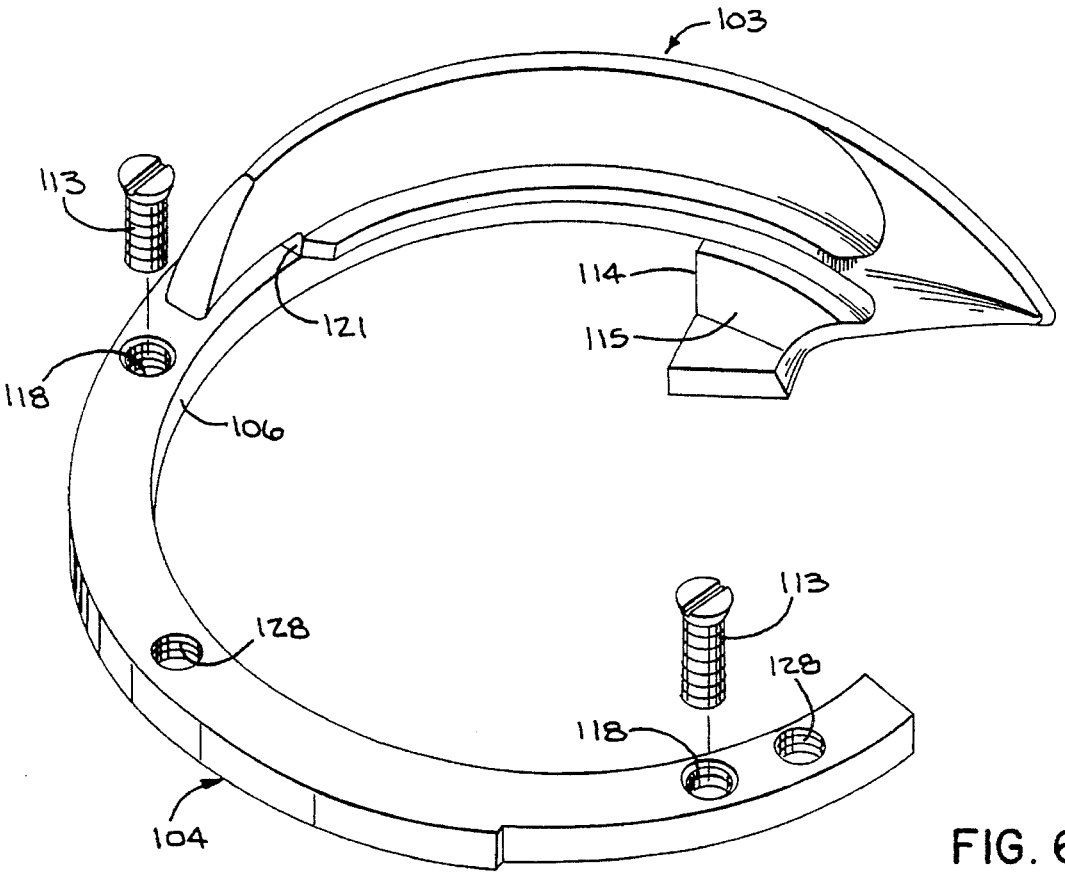
FIG. 6 is a similar view of the combination loop seizing point and bobbin case raceway-defining means that is included in said second embodiment of the rotary loop taker of this invention.

In the assembly of this embodiment, the combination shown in FIG. 6 of detachable loop seizing point 103 and that part of the bobbin case raceway-defining means—indicated as member 104—that defines inwardly facing vertical wall 106 are first secured to frame 30. After the radially extending rib of the bobbin case (not shown) is inserted in the resulting partially formed raceway, gib 26 shown in FIG. 3 is secured to combination member 103/104, and thus indirectly to frame 30, to complete the raceway. Finally, needle guard 28 shown in FIG. 4 is attached to frame 30.

Substantially annular frame 30 has the same construction as frame 20 of FIG. 1 (described above), with a single exception. The single exception is that frame 30 carries the part of the raceway-defining means that defines upwardly facing lower ledge 108 of the bobbin case raceway. The part of the raceway-defining means in question is top wall 110 of frame 30 in FIG. 5, which is the part of the frame that lies above the horizontal plane that passes through phantom line 112.

The combination of detachable loop seizing point 103 and raceway-defining means 104 has the same construction as combination 22/24 of FIG. 2 (described above), again with a single exception. Here the single exception is that the part of the raceway-defining means that defines the upwardly facing lower ledge of the raceway is omitted, having been replaced in function (as seen in FIG. 5) by top wall 110 of annular frame 30 and inner edge 108 of that wall. FIG. 6 shows that inwardly facing vertical wall 106 performs the same function in this second preferred embodiment that is performed by vertical wall 86 in the first embodiment illustrated in FIGS. 1 through 4. As with the embodiment illustrated in those earlier Figures, the bobbin case raceway-defining means comprised of members 104 and 106 extends throughout the middle and final portions of the raceway.

As shown in FIGS. 5 and 6, combination 103/104 is secured to frame 30 by means of bolts 113. Rear wall 114 of downwardly extending support lug 115 is first positioned against forward end wall 116 of annular frame 30, with positioning stud 117 carried by wall 116 inserted in the mating cavity (not shown) in wall 114. Bolts 113 are then inserted in chamfered apertures 118 in members 103/104, and are screwed into threaded apertures 119 in annular frame 30.

As with the first embodiment, the raceway of this second embodiment of the rotary loop taker of the instant invention is completed by the attachment of gib 26 of FIG. 3 to raceway-defining means 104, and thus indirectly to annular frame 30. It should be noted, however, that the bolts for securing gib 26 should in this case be only long enough to pass through apertures 92 in the gib and be threadably engaged in apertures 128 in member 104.

Forward end 100 of gib 26 abuts rear wall 121 of the loop seizing point (FIGS. 3 and 6). The gib completes the bobbin case raceway by defining downwardly facing upper ledge 102 of the middle and final portions of the raceway.

C.

Figure 7:
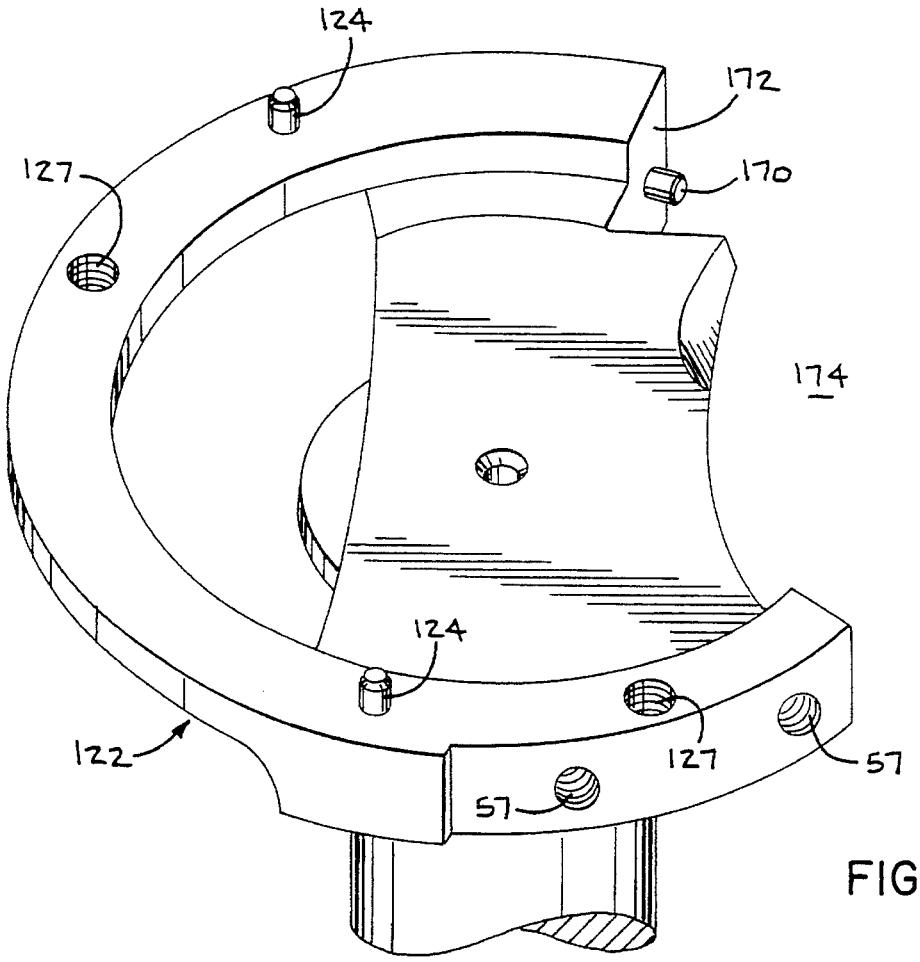
FIG. 7 is a similar view of the substantially annular frame that is included in a third, fourth and fifth embodiment of the rotary loop taker of this invention.

FIG. 7 shows a substantially annular frame 122 that is included in a third embodiment of the rotary loop taker of this invention. The lower half of FIG. 8 and FIGS. 6 and 3 complete the illustration of this embodiment.

To summarize the assembly of this third embodiment, raceway-defining means or spacer member 123 in the form of a circular segment (bottom part of FIG. 8) is-first placed on annular frame 122. The combination shown in FIG. 6 of detachable loop seizing point 103 and bobbin case raceway-defining means 104 is then secured to frame 122 in an overlying position above member 123. After the radially extending rib of the bobbin case (not shown) is inserted in the resulting partially formed raceway, gib 26 shown in FIG. 3 is secured to combination member 103/104, and thus indirectly to frame 122, to complete the raceway. Needle guard 28 shown in FIGURE 4 is then attached to the frame.

Figure 8:
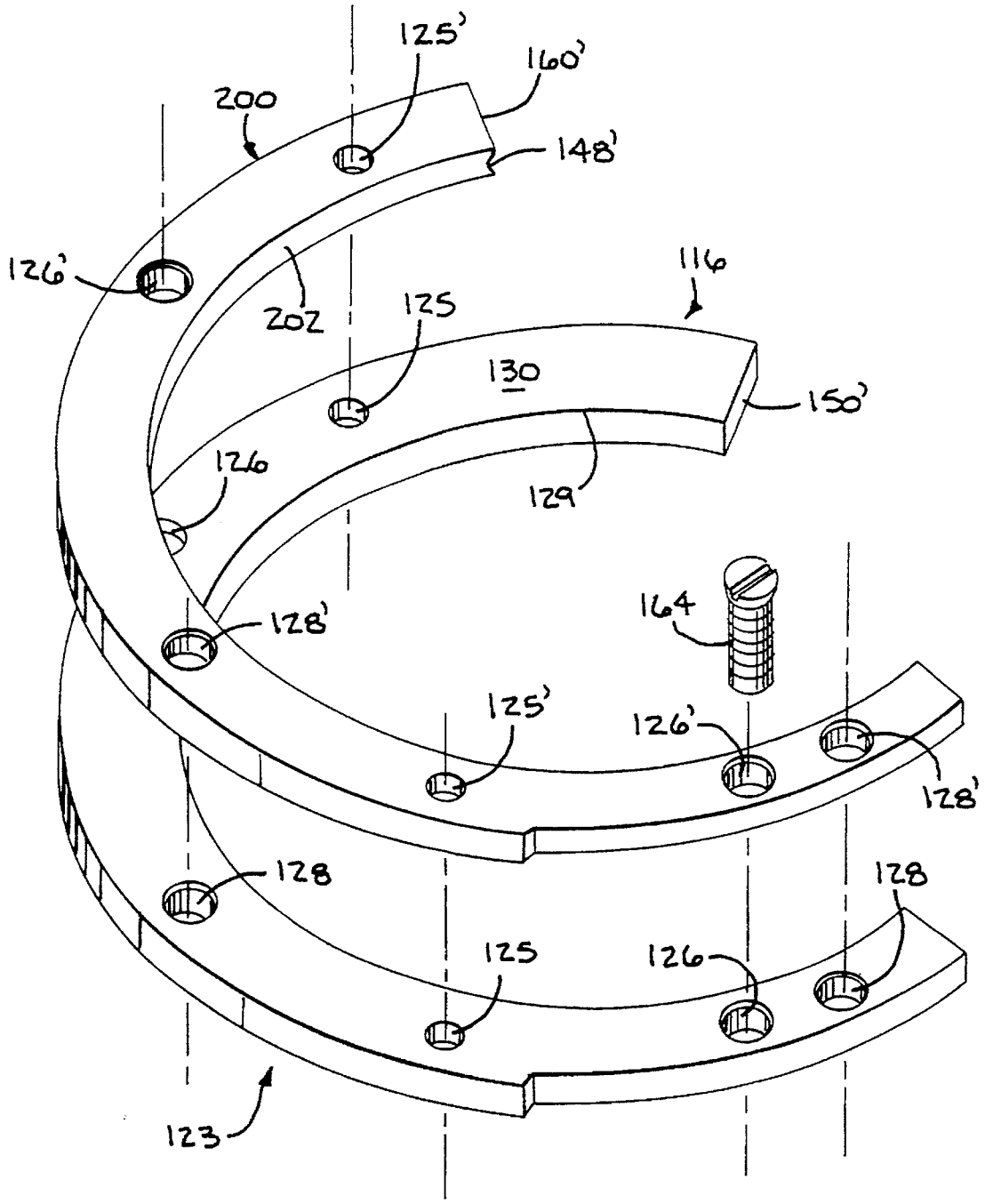
FIG. 8 is a similar view of two spacer members that can be incorporated in rotary loop takers according to the present invention, the lower one being detachably secured to the annular frame in said third embodiment of the rotary loop taker of this invention.

Substantially annular frame 122 shown in FIG. 7 is the same as frame 20 of FIG. 1, with the addition of positioning studs 124. In the first step of the assembly of this embodiment of the rotary loop taker of this invention, raceway-defining means or spacer member 123 is placed on annular frame 122 by inserting studs 124 in apertures 125 in member 123 (FIGS. 7 and 8). Studs 124 should be only long enough to be fully inserted in member 123.

Combination member 103/104 and spacer member 123 are then secured to frame 122 by means of bolts 113, which are inserted in chamfered apertures 118 in member 103/104, through apertures 126 in spacer member 123, and then into threaded engagement with apertures 127 in frame 122 (FIGS. 6, 8 and 7).

To complete the assembly of the raceway, gib 26 is secured to combination member 103/104 by inserting bolts 90 through apertures 92 in the gib and screwing them into threaded apertures 128 in spacer member 123. The bolts by which the gib is thus secured should be only long enough to pass through the gib and be threadably engaged in apertures 128.

Needle guard 28 is then attached to annular frame 121, to complete the rotary loop taker.

As will be seen, in this third embodiment of the rotary loop taker of the present invention, inner edge 129 of upper wall 130 of spacer member 123 defines the upwardly facing lower ledge of the bobbin case raceway (FIG. 8). As in the second embodiment, inner wall 106 of raceway-defining means 104 defines the inwardly facing vertical wall of the raceway (FIG. 6).

Both Vertical Wall And Lower Ledge Defined By Raceway-Defining Means Formed Separately From Detachable Loop Seizing Point

D.

Figure 11:
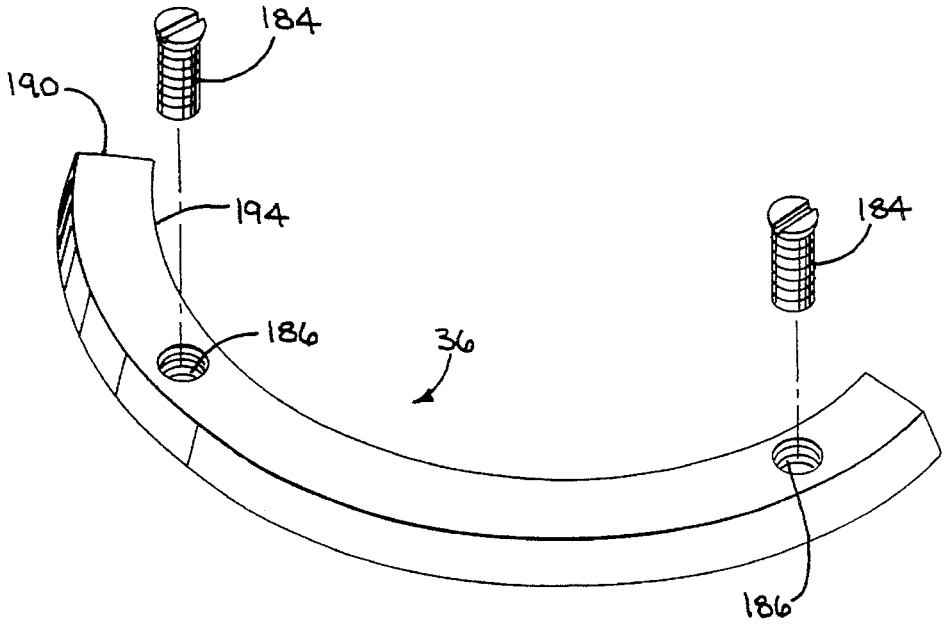
FIG. 11 (on the same sheet as FIG. 7) is a similar view of the gib that is included in said fourth embodiment of the rotary loop taker of this invention.
Figure 10:
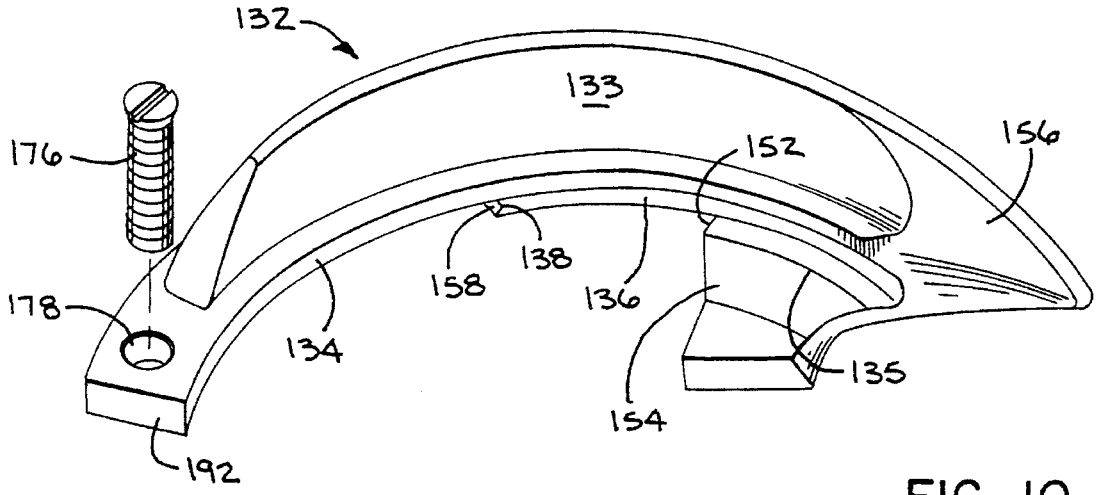
FIG. 10 is a similar view of the detachable loop seizing point that is included in said fourth embodiment of the rotary loop taker of this invention.
Figure 9:
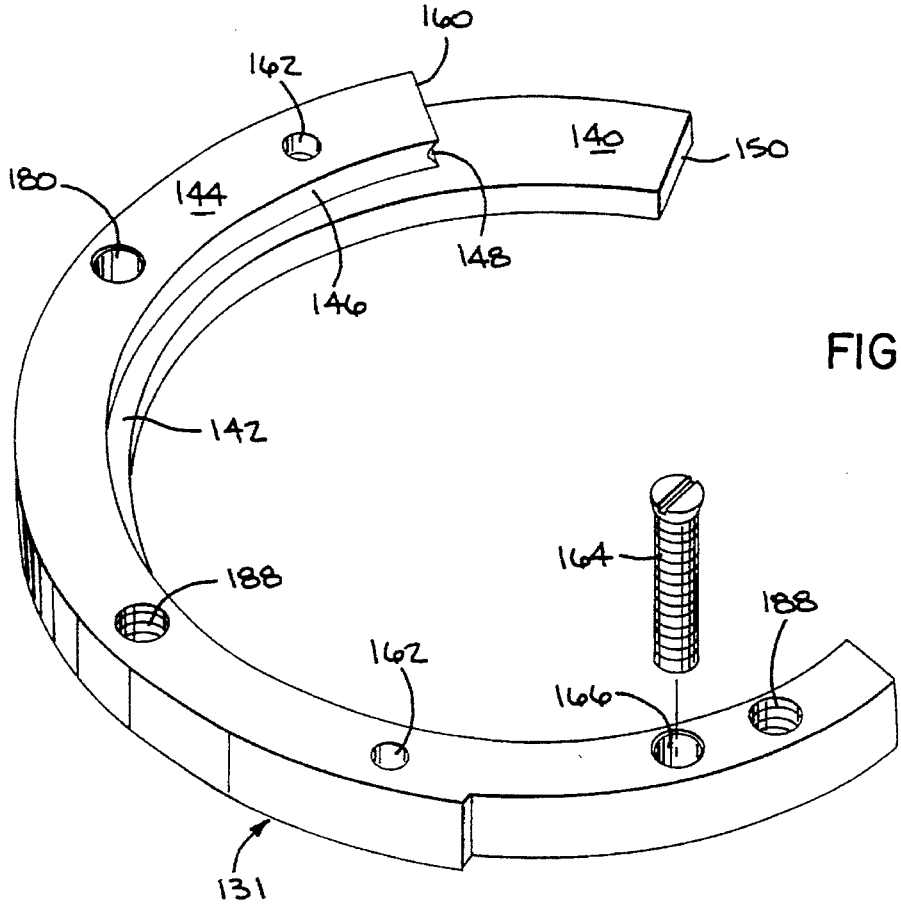
FIG. 9 is a similar view of a spacer member that is included in said fourth embodiment of this invention.

Substantially annular frame 122 of FIG. 7, spacer member 131 of FIG. 9, detachable loop seizing point 132 of FIG. 10, and gib 36 of FIG. 11 (the latter Figure on the same sheet as FIG. 7) are included in a fourth embodiment of the rotary loop taker of this invention.

To summarize the assembly of this embodiment, raceway-defining means or spacer member 131 in the form of a circular segment (FIG. 9) is first secured to annular frame 122 (FIG. 7). Detachable loop seizing point 132 of FIG. 10 is then secured to the spacer member and annular frame. After the radially extending gib of the bobbin case (not shown) is inserted in the resulting partially formed raceway, gib 36 shown in FIG. 11 is secured to spacer member 131. Needle guard 28 is then attached to frame 122.

As seen in FIG. 10, inner wall 133 of detachable loop seizing point 132 carries downwardly facing upper ledge 134 that defines the upper part of the initial portion of the bobbin case raceway. It also carries upwardly facing lower ledge 135 that defines the lower part of the initial portion of the raceway. Finally, inner wall 133 defines inwardly facing vertical wall 136 for the raceway, located between upper ledge 134 and lower ledge 135. The trailing end portion 158 of vertical wall 136 (as loop seizing point 132 rotates in the clockwise direction in FIG. 10) is provided with a small bevel 138.

Raceway-defining member 131 includes first spacer member 140, which is carried by annular frame 122, to define lower ledge 142 of the middle and final portions of the bobbin case raceway (FIGS. 9 and 7). Second spacer member 144 is integrally formed with first spacer member 140. Member 144 defines inwardly facing vertical wall 146 spaced radially outward from lower ledge 142. The leading end 160 of vertical wall 146, as raceway-defining means 131 rotates in the clockwise direction as seen in FIG. 9, is provided with a small bevel 148.

When detachable loop seizing point 132 is positioned on raceway-defining means 131, forwardly facing end wall 150 of spacer member 140 abuts rearwardly facing wall 152 of support lug 154 that extends downward from detachable loop seizing point 132 from immediately behind its forward end 156. End 158 of inwardly facing vertical wall 136 defined by inner wall 133 of loop seizing point 132 abuts forwardly facing end wall 160 of raceway-defining means or spacer member 144.

Spacer members 140 and 144 are positioned on annular frame 122 by inserting positioning studs 124 of frame 122 into apertures 162 of member 131, inserting bolt 164 through chamfered aperture 166 in the spacer member, and screwing the bolt into threaded aperture 127 on the annular frame (FIGS. 7 and 9). Bolt 164 must be long enough to pass through spacer member 131 and be securely engaged in aperture 127 of the annular frame.

Detachable loop seizing point 132 is positioned on spacer member 131 and annular frame 122 by inserting stud 170 carried by end wall 172 at the trailing end of cut-away portion 174 of the frame in the mating cavity (not shown) on trailing end wall 152 of downwardly extending supporting lug 154 of the loop seizing point (FIGS. 7 and 10). The loop seizing point is then secured to spacer member 131, and through it to annular frame 122, by inserting bolt 176 in aperture 178 at the rear end of the loop seizing point, through aperture 180 in raceway-defining means 131 (in the upper left-hand corner of FIG. 9), and into threaded engagement with aperture 127 of frame 122 (in the upper left-hand corner of FIG. 7). Bolt 176 should be long enough to pass through members 132 and 131, and form a secure threaded engagement with annular frame 122.

The bobbin case raceway in this embodiment of the rotary loop taker of this invention is completed by securing gib 36 shown in FIG. 11 (on the same sheet as FIG. 7) to spacer member 131. Bolts 184 are inserted in chamfered apertures 186 in gib 36, and then are screwed into threaded apertures 188 in the spacer member. The bolts should be no longer than required to effect a secure threaded engagement with member 131.

When gib 36 is installed in place, its forward end wall 190 abuts end wall 192 at the rear end of loop seizing point 132. The gib defines upper ledge 194 of the middle and final portions of the bobbin case raceway.

E.

FIGS. 7, 8, 10 and 11 illustrate a fifth embodiment of the rotary loop taker of this invention.

This embodiment is similar to the fourth embodiment just described, except that the inwardly facing vertical wall and upwardly facing lower ledge of the bobbin case raceway are defined by two separately formed spacer members instead of by a single, integrally formed spacer member. As shown in FIG. 8, spacer member 123 in the form of a circular segment defines Upwardly facing lower ledge 129 of the bobbin case raceway. Spacer member 200 in the form of another circular segment defines inwardly facing vertical wall 202 of the raceway.

In the assembly of this embodiment, spacer members 123 and 200 are secured to annular frame 122 of FIG. 7 by inserting positioning studs 124 of frame 122 into apertures 125 and 125' of the two spacer members, inserting bolt 164 through apertures 126' and 126 in the lower right-hand corner of FIG. 8 (only the upper one of which needs to be chamfered), and screwing the bolt into threaded aperture 127 on the annular frame in alignment with those apertures 126' and 126 (FIGS. 7 and 8).

Detachable loop seizing point 132 is then positioned on spacer members 123 and 200 and on annular frame 122 by inserting stud 170 on end wall 172 of the frame in the mating cavity (not shown) on end wall 152 of supporting lug 154 of the loop seizing point. The loop seizing point is secured to the spacer members, and through them to the annular frame, by inserting bolt 176 in aperture 178, through apertures 126' and 126 (in the upper left-hand corner of FIG. 8) in the spacer members, and into threaded engagement with aperture 127 in the upper left-hand portion of frame 122 (FIGS. 7 and 10).

When spacer members 123 and 200 and loop seizing point 132 are installed in place, end walls 150 ' and 160', respectively, of the two spacer members function in the same way as end walls 150 and 160 of spacer members 140 and 144, shown in FIG. 9 and discussed above. Likewise, end wall 160' is beveled at 148' in the same way as end wall 160, previously discussed.

The bobbin case raceway in this embodiment is completed by securing gib 36 shown in FIG. 11 to spacer members 123 and 200, by means of bolts 184. The bolts are inserted in apertures 186 in gib 36, and then are screwed into threaded apertures 128' and 128 in spacer members 200 and 123, respectively. When gib 36 is installed in place, it defines upper ledge 194 of the middle and final portions of the bobbin case raceway.

F.

Figure 12:
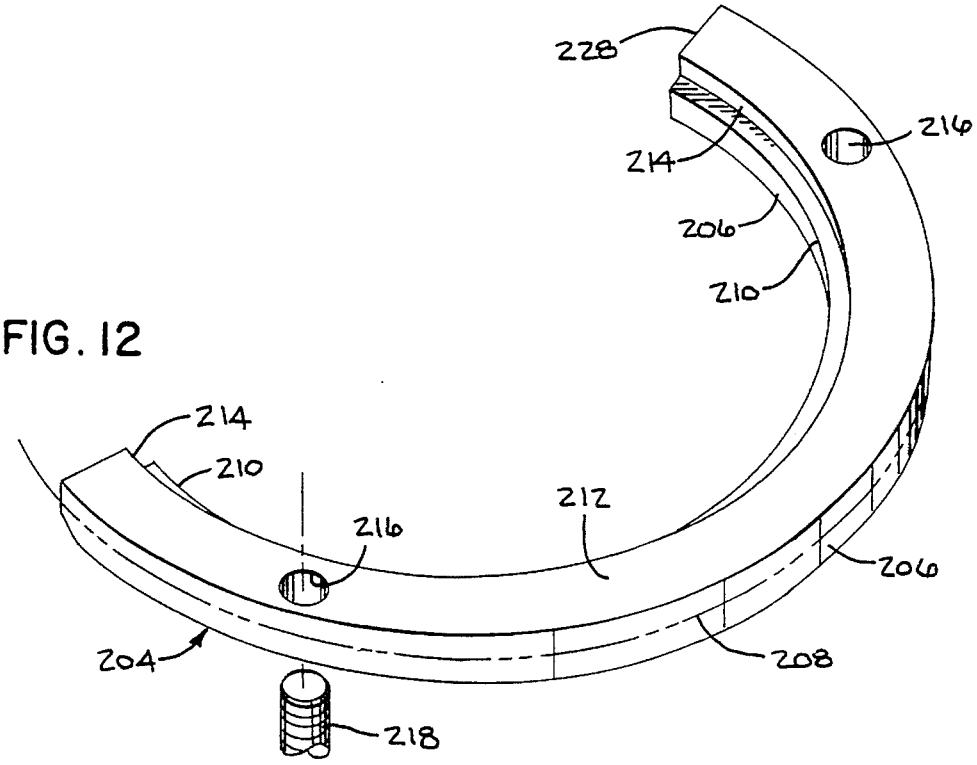
FIG. 12 (on the same sheet as FIG. 5) is a three-quarter perspective view from the bottom of a combination of a gib and a member defining the inwardly facing vertical wall of the bobbin case raceway that is included in another embodiment of the rotary loop taker of this invention.

FIGS. 5, 12 (on the same sheet as FIG. 5), and 13 (on the same sheet as FIG. 6) illustrate another embodiment of this invention.

In this further embodiment, gib 204 (shown in FIG. 12 in a three-quarters perspective view from the bottom) includes the structure of the usual gib, and in addition a part of the raceway-defining means of the rotary loop taker of this invention formed integrally with that structure. The part of gib 204 that performs the traditional function of a gib is upper part 206, which is actually located below phantom line 208 in the upside-down view shown in FIG. 12. As there seen, when gib 204 is turned over into its normal position, part 206 will define downwardly facing upper ledge 210 of the bobbin case raceway.

When the gib is turned over into the position it occupies when installed in the rotary loop taker of this invention, part 212 of gib 204 will lie below phantom line 208. In that position, part 212 of gib 204 will define inwardly facing vertical wall 214 of the bobbin case raceway, outwardly spaced from upper ledge 210 and lower ledge 108 below it (FIGS. 5 and 12).

In the assembly of this embodiment of the rotary loop taker of this invention, gib 204 is turned over and laid on annular frame 30, with apertures 216 of the gib aligned with corresponding apertures 119 of the annular frame. Bolt 218 (shown in fragmentary fashion in FIG. 12) is thereafter inserted in aperture 216 (in the lower right-hand corner of FIG. 12 after gib 204 has been turned over), and screwed into threaded aperture 119 in the lower right-hand corner of FIG. 5.

Figure 13:
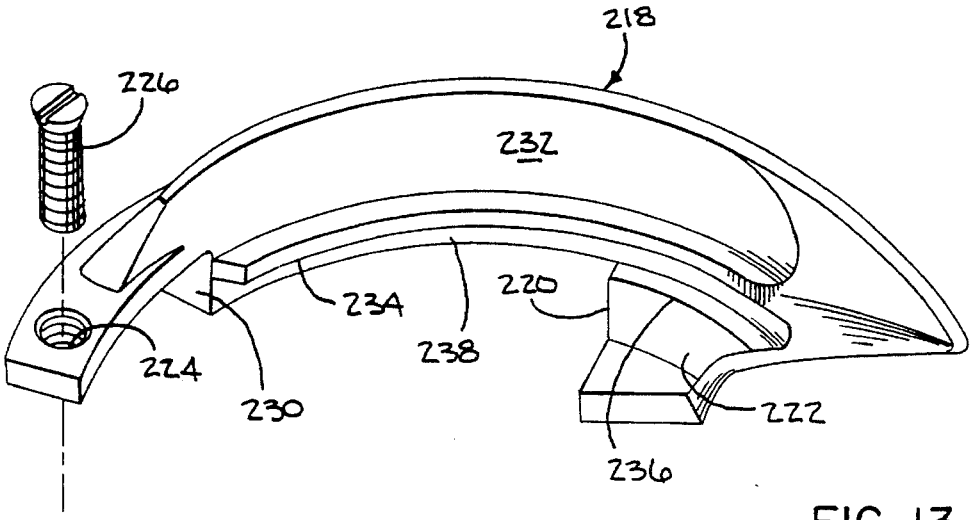
FIG. 13 (on the same sheet as FIG. 6) is a three-quarter perspective view from the top of the detachable loop seizing point included in said last mentioned embodiment of the rotary loop taker of this invention.

Detachable loop seizing point 218 shown in FIG. 13 (on the same sheet as FIG. 6) is positioned on annular frame 30 by inserting positioning stud 117 in the mating cavity (not shown) carried by rear wall 220 of downwardly extending supporting lug 222 of the loop seizing point, and aligning chamfered aperture 224 at the rear end of the loop seizing point with aperture 216 of gib 204 (in the upper left-hand corner of FIG. 12 after the gib has been turned over) and aperture 119 of frame 30 (in the upper left-hand corner of FIG. 5). Loop seizing point 218 and gib 204 (including integrally formed part 212) are then secured to frame 30 by inserting bolt 226 through aligned apertures 224 and 216 and screwing the bolt into threaded aperture 119 of frame 30.

It will be seen that when gib 204 is turned over and installed on annular frame 30 in the manner described, leading end wall 228 of the gib will abut trailing end wall 230 of loop seizing point 218. (FIGS. 12 and 13).

FIG. 13 illustrates how inner wall 232 of loop seizing point 218 defines downwardly facing upper ledge 234, upwardly facing lower ledge 236, and inwardly facing vertical wall 238 between those ledges, all in the initial portion of the bobbin case raceway. As seen in FIG. 5, upper wall 110 and inner ledge 108 of frame 30 define the lower ledge of the raceway in the middle and final portions thereof. FIG. 12 shows how inwardly facing vertical wall 214 and downwardly facing upper ledge 210 are de fined by gib 204 in the middle and final portions of the raceway.

The addition of the needle guard completes the rotary loop taker.

G.

Another embodiment of the rotary loop taker of this invention is illustrated in FIGS. 14, 15, 10 and 11 (the latter on the same sheet with FIG. 7).

Figure 14:
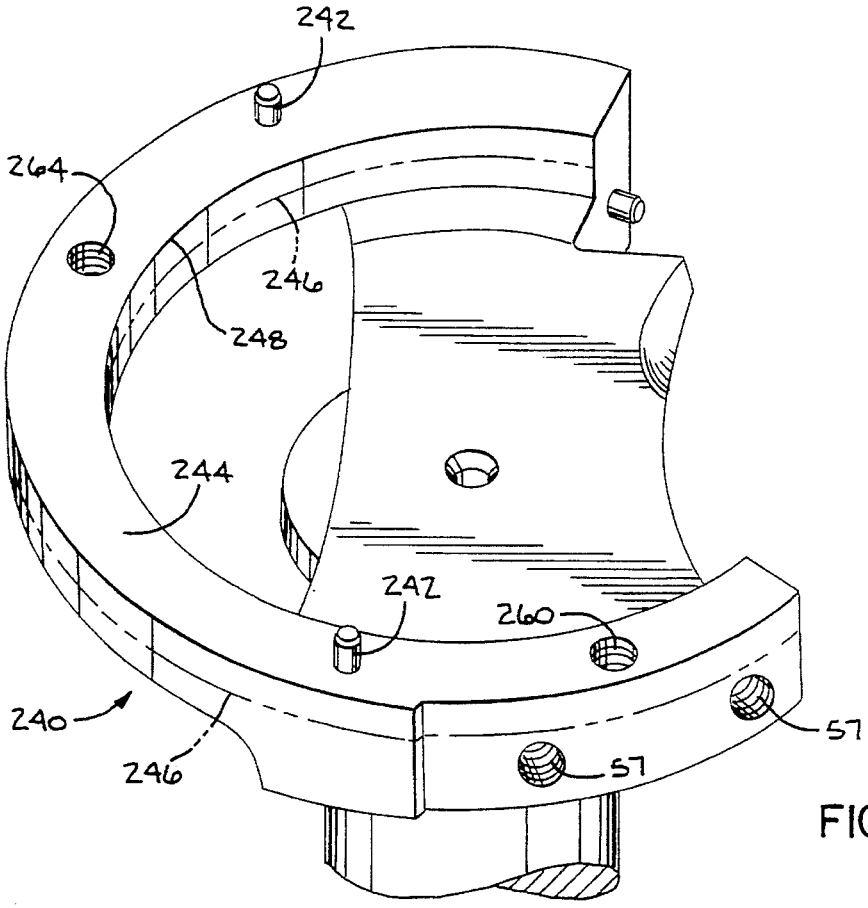
FIG. 14 is a similar view of the substantially annular frame that is included in still another embodiment of the rotary loop taker of this invention.

Substantially annular frame 240 shown in FIG. 14 is the same as frame 30 shown in FIG. 5, with the addition of positioning studs 242. Top wall 244 (located above the horizontal plane passing through phantom line 246) and its inner edge 248 define the upwardly facing lower ledge of the bobbin case raceway in this embodiment.

Figure 15:
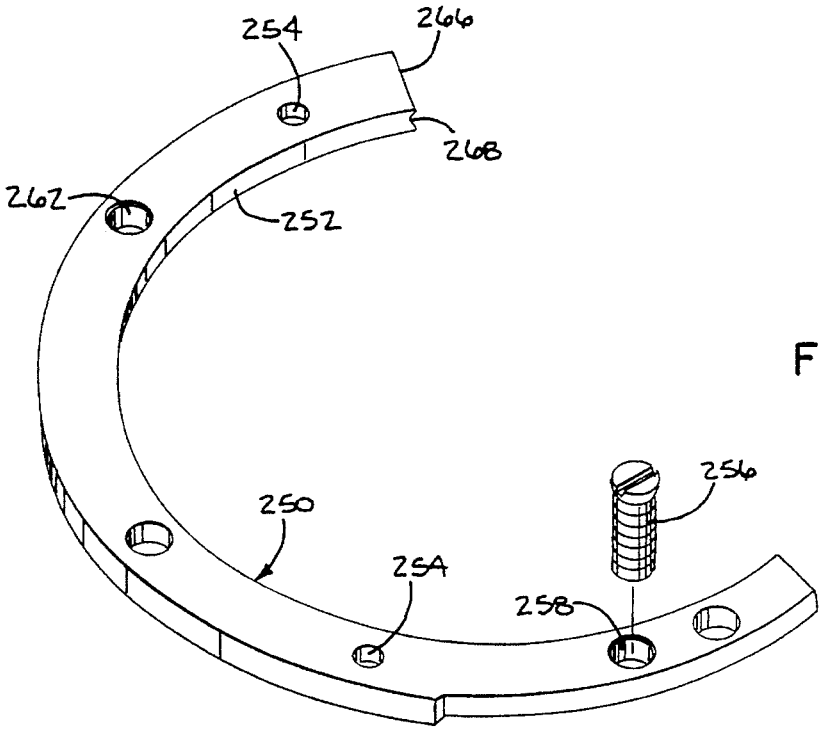
FIG. 15 is a similar view of a spacer member that is included in said last mentioned embodiment of the rotary loop taker of this invention.

Spacer member 250 shown in FIG. 15 defines inwardly facing vertical wall 252 of the bobbin case raceway. It is installed in place on annular frame 240 by inserting positioning studs 242 in apertures 254 in spacer member 250, inserting bolt 256 through chamfered aperture 258 therein, and screwing the bolt into threaded aperture 260 in frame 240 in the lower right-hand corner of FIG. 14. When thus installed, inwardly facing vertical wall 252 is outwardly spaced from upwardly facing lower ledge 248 of the bobbin case raceway. Forward end wall 266 of spacer member 250, beveled at 268, abuts trailing end wall 158 of inwardly facing vertical wall 136 of loop seizing point 132 (FIGS. 10 and 15).

Loop seizing point 132 shown in FIG. 10 is installed in place with bolt 176 inserted through aperture 178 at the rear end of the loop seizing point and aperture 262 in spacer member 250. The bolt is then screwed into threaded aperture 264 in annular frame 240.

The raceway is completed by installing gig 36 of FIG. 11 in the same manner as has been described above for previous embodiments.

The embodiments of the rotary loop taker of this invention discussed above all incorporate the basic inventive concept of forming the inwardly facing vertical wall of the bobbin case raceway separately from the substantially annular frame, while forming the upwardly facing lower ledge of the bobbin case raceway either integrally with or separate from the frame. The advantages of the various embodiments disclosed have been discussed above in this specification.

From that discussion, it is seen that the rotary loop taker of this invention provides a valuable device that can be sold as original equipment. In addition, it is clear that the sale of new loop seizing points and raceway-defining means as replacement parts for damaged elements in a rotary loop taker according to this invention, which was first sold as original equipment, will be a significant part of any business in which this important invention is practiced. For this reason, a group of subcombination claims is included in this application to cover the invention of the loop seizing point and part or all of the raceway-defining means separately from the remainder of the rotary loop taker.

The above detailed description has been given for ease of understanding only. No unnecessary limitations should be understood therefrom, as modifications will be obvious to those skilled in the art.

I claim:

1. A rotary loop taker for rotation about a generally cylindrical bobbin case maintained in a fixed position in a lock-stitch sewing machine below the take-up device of said machine, a side wall of said bobbin case carrying a radially extending rib for engaging an inwardly facing raceway on said loop taker as the loop taker rotates about said bobbin case, said raceway having a downwardly facing upper ledge, an upwardly facing lower ledge, and an inwardly facing vertical wall located between said upper ledge and said lower ledge, which comprises:

(a) a frame of substantially annular construction, said frame having a cut-away portion along one segment of its circumference, said cut-away portion being defined by opposing end walls of said frame facing upon said cutaway portion;

(b) means for rotatably supporting said frame in said lock-stitch sewing machine;

(c) a detachable loop seizing point with spaced ends mounted on said frame having generally the same curvature as said substantially annular frame, said detachable loop seizing point:

(i) being integrally formed from one end of said detachable loop seizing point to the other end of said detachable loop seizing point, (ii) having a single tapered, smoothly shaped, integrally formed forward end, (iii) having a supporting lug that extends directly downward from immediately behind said forward end into said cut-away portion of said frame, and has a rear surface that abuts at all times, throughout substantially the entire height of the lug, the surface of the one of said frame end walls that is at a trailing end of said cut-away portion during forward rotation of said frame, said forward end of the detachable loop seizing point extending forwardly of said downwardly extending lug into said cut-away portion of said frame, (iv) having a rear portion extending rearwardly of said lug along said annular frame, and (v) having an inner wall and an outer wall, said inner wall:

defining an initial portion of said upper ledge of said raceway, defining an initial portion of said lower ledge of said raceway, and defining an initial portion of said vertical wall of said raceway;

(d) raceway-defining means carried by said substantially annular frame to define said lower ledge and said vertical wall in at least a middle portion of said raceway, at least the part of said raceway-defining means that defines said vertical wall being formed separately from said annular frame;

(e) a gib detachably secured to said frame to define said upper ledge of a final portion and said middle portion of the raceway; and (f) means for detachably securing said loop seizing point to said frame, said means being located entirely rearward of said tapered forward end of said loop seizing point.

2. The rotary loop taker of claim 1 in which said raceway-defining means is formed entirely separately from said substantially annular frame.

3. The rotary loop taker of claim 2 in which all parts of said raceway-defining means are integrally formed with each other and with said detachable loop seizing point.

4. The rotary loop taker of claim 2 in which the part of said raceway-defining means that defines aid vertical wall is integrally formed with said loop seizing point, and the part that defines said lower ledge is separately formed from said loop seizing point.

5. The rotary loop taker of claim 2 in which said raceway-defining means that defines said lower ledge and said vertical wall in the middle portion of said raceway is formed entirely separately from both said frame and said loop seizing point.

6. The rotary loop taker of claim 1 in which the part of said raceway-defining means that defines said lower ledge is in integrally formed with said frame.

7. The rotary loop taker of claim 6 in which the part of said raceway-defining means that defines said vertical wall is integrally formed with said loop seizing point.

8. The rotary loop taker of claim 6 in which the part of said raceway-defining means that defines said vertical wall is formed separately from said loop seizing point.

9. The rotary loop taker of claim 1 in which said raceway-defining means defines said lower ledge and said vertical wall in both the middle portion and the final portion of said raceway.

10. The rotary loop taker of claim 9 in which said raceway-defining means is formed entirely separately from said frame.

11. The rotary loop taker of claim 10 in which all parts of said raceway-defining means are integrally formed with each other and with said loop seizing point.

12. The rotary loop taker of claim 11 in which said raceway-defining means is detachably secured to the frame between said frame and said gib.

13. The rotary loop taker of claim 10 in which the part of said raceway-defining means that defines said vertical wall is integrally formed with said loop seizing point, and the part that defines said lower ledge is separately formed from said loop seizing point.

14. The rotary loop taker of claim 13 in which the part of said raceway-defining means that defines said lower ledge is detachably secured to the frame.

15. The rotary loop taker of claim 10 in which the parts of said raceway-defining means that define said lower ledge and said vertical wall in the middle portion of said raceway are formed entirely separately from both said frame and said loop seizing point.

16. The rotary loop taker of claim 15 in which said raceway-defining means includes a separate spacer member in the form of a segment of a circle that is detachably secured to said frame between the frame and said gib, said spacer member defining said lower ledge in the middle portion of said raceway.

17. The rotary loop taker of claim 15 in which said raceway-defining means includes a first spacer member in the form of a segment of a circle that is detachably secured to said frame to define said lower ledge of the middle and final portions of the raceway, and a second spacer member in the form of a segment of a circle above said first spacer member to define said vertical wall of the middle and final portions of the raceway.

18. The rotary loop taker of claim 17 in which said first and second spacer members are integrally formed.

19. The rotary loop taker of claim 17 in which said first and second spacer members are separately formed.

20. The rotary loop taker of claim 9 in which the part of said raceway-defining means that defines said lower ledge in said middle and final portion of the raceway is integrally formed with said frame.

21. The rotary loop taker of claim 20 in which said raceway-defining means includes a top wall of said frame, the inner edge of the top wall defining said lower ledge in said middle and final portions of the raceway.

22. The rotary loop taker of claim 21 in which the part of said raceway-defining means that forms said vertical wall of said middle and final portions of the raceway is formed separately from said frame and from said loop seizing point.

23. The rotary loop taker of claim 22 in which said raceway-defining means includes a separately formed spacer member in the form of a segment of a circle that is detachably secured to said frame between the frame and said gib, said spacer member defining said vertical wall in said middle and final portions of the raceway.

24. The rotary loop taker of claim 22 in which said gib carries as an integral part thereof a lower portion in the form of a circular segment that defines said vertical wall in the middle and final portions of said raceway, said vertical wall being spaced radially outward from said upper ledge defined by said gib.

25. The rotary loop taker of claim 20 in which said raceway-defining means includes a member that is integrally formed with said loop seizing point and extends from said rare portion of the loop seizing point along the circumference of said annular frame to define said vertical wall spaced radially outward from said upwardly facing lower ledge in said middle and final portions of this raceway.

26. A detachable loop seizing point in combination with raceway-defining means for use in a rotary loop taker mounted to rotate about a generally cylindrical bobbin case maintained in a fixed position in a lock-stitch sewing machine below the take-up device of said machine, a side wall of said bobbin case carrying a radially extending rib for engaging an inwardly facing raceway on said loop taker as the latter rotates about said bobbin case, said raceway having a downwardly facing upper ledge, an upwardly facing lower ledge, and an inwardly facing vertical wall located between said upper ledge and said lower ledge, said rotary loop taker including a frame of substantially annular construction, said frame having a cut-away portion along one segment of the circumference of the frame, said cut-away portion being defined by opposing end walls of said frame facing upon said cut-away portion, and also including a gib detachably secured to said frame to define the upper ledge of a middle portion and a final portion of said raceway, which comprises:

(a) a detachable loop seizing point with spaced ends that includes:

(i) a single tapered, smoothly shaped, integrally formed forward end, (ii) a supporting lug that:

extends directly downward from immediately behind said forward end into said cut-away portion of said frame, and has a rear surface that abuts at all times, throughout substantially the entire height of the lug, the surface of the one of said frame end walls that is at a trailing end of said cut-away portion during forward rotation of said frame, said forward end of the detachable loop seizing point extending forwardly of said downwardly extending lug into said cut-away portion of said frame, (iii) a rear portion extending rearwardly of said lug, said forward end, supporting lug and rear portion of the loop seizing point having generally the same over-all curvature as said substantially annular frame and being integrally formed from one end to the other end of the loop seizing point, (iv) an inner wall and an outer wall, said inner wall:

defining an initial portion of said upper ledge of said raceway, defining an initial portion of said lower ledge of said raceway, and defining an initial portion of said vertical wall of said raceway;

(b) raceway-defining means defining at least one of said vertical wall and said lower ledge in said middle portion of the raceway, said means being integrally formed with said loop seizing point; and (c) means for detachably securing said integrally formed loop seizing point and raceway-defining means to said frame, said means being located entirely rearward of said tapered forward end of the loop seizing point.

27. The combination of claim 26 in which said raceway-defining means includes an inwardly facing vertical surface that extends from said rear portion of the loop seizing point along the circumference of said frame to define said vertical wall in the middle portion of said raceway.

28. The combination of claim 27 in which said inwardly facing vertical surface extends an additional distance along the circumference of said frame to define said vertical wall in said final portion of the raceway.

29. The combination of claim 27 in which said raceway-defining means also includes an upwardly facing lower surface that extends from said rear portion of the loop seizing point along the circumference of said frame to define said lower ledge in the middle portion of said raceway.

30. The combination of claim 29 in which both said inwardly facing vertical surface and said upwardly facing lower surface extend an additional distance along the circumference of said frame to define said vertical wall and said lower ledge in said final portion of the raceway.

* * * * *